US008561435B2

(12) United States Patent
Bruske et al.

(10) Patent No.: US 8,561,435 B2
(45) Date of Patent: Oct. 22, 2013

(54) LATCH NEEDLE WITH IMPROVED LATCH BEARING

(71) Applicant: Groz-Beckert KG, Albstadt (DE)

(72) Inventors: Johannes Bruske, Albstadt (DE); Juergen Veeser, Nusplingen (DE); Werner Veeser, Nusplingen (DE); Jochen Stauss, Albstadt (DE); Eric Juergens, Bisingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/710,977

(22) Filed: Dec. 11, 2012

(65) Prior Publication Data

US 2013/0152639 A1 Jun. 20, 2013

(30) Foreign Application Priority Data

Dec. 14, 2011 (EP) ..... 11193546

(51) Int. Cl.
*D04B 35/04* (2006.01)

(52) U.S. Cl.
USPC ..... 66/122

(58) Field of Classification Search
USPC ..... 66/121, 122, 116
See application file for complete search history.

(56) References Cited

U.S. PATENT DOCUMENTS

| | | | | | |
|---|---|---|---|---|---|
| 600,692 | A | * | 3/1898 | Huke et al. | 66/122 |
| 743,152 | A | | 11/1903 | Currier | |
| 1,928,964 | A | | 10/1933 | Currier | |
| 2,711,218 | A | * | 6/1955 | Vitoux | 163/5 |
| 2,767,566 | A | * | 10/1956 | Parsons | 66/122 |
| 3,459,009 | A | * | 8/1969 | Strohlein et al. | 66/122 |
| 3,568,472 | A | | 3/1971 | Berentzen | |
| 3,677,035 | A | | 7/1972 | Wiederhut et al. | |
| 4,723,425 | A | | 2/1988 | Majer | |
| 4,747,277 | A | * | 5/1988 | Majer | 66/122 |
| 7,913,519 | B2 | | 3/2011 | Veeser | |

FOREIGN PATENT DOCUMENTS

| | | | |
|---|---|---|---|
| DE | 14407 | C | 12/1880 |
| DE | 917243 | C | 8/1954 |
| DE | 1585089 | A1 | 2/1970 |
| DE | 3600621 | C1 | 5/1987 |
| EP | 2224048 | A1 | 9/2010 |

OTHER PUBLICATIONS

European Search Report; EP11193546.6 dated Jun. 8, 2012; 6 pgs.

* cited by examiner

*Primary Examiner* — Danny Worrell
(74) *Attorney, Agent, or Firm* — Fitch, Even, Tabin & Flannery LLP

(57) ABSTRACT

A latch needle includes a pivot pin connected with the latch in a torque-proof manner, said pivot pin having mirror-symmetrically shaped bearing heads (29, 30) on both sides of the latch shank (20). The bearing heads (29, 30) are produced by plastic deformation (i.e., axial upsetting of a pin (27)) and have a cylindrical exterior shape.

14 Claims, 6 Drawing Sheets

LATCH NEEDLE WITH IMPROVED LATCH BEARING

RELATED APPLICATIONS

This application claims the benefit of European Patent Application No. 11193546.6 filed Dec. 14, 2011, the contents of which are incorporated herein by reference as if fully rewritten herein.

TECHNICAL FIELD

The invention relates to a latch needle that can be used in textile machines such as, e.g., circular knitting machines, flat-bed knitting machines, or warp-knitting machines.

BACKGROUND

Basically, latch needles have been known from publication DE 36 00 621 C1, for example. They have a base body with a shank terminating in a hook on one end. A latch slot is provided in the shank in the vicinity of the hook. The latch shank of a pivotably supported latch extends into the latch slot. A latch hole is provided on the end of the latch shank, in which case a pivot pin extends through said latch hole. The latch slot is delimited by two lateral walls. An opening is provided in each lateral wall. Both openings are in alignment with each other. The pivot pin extends through the latch hole and is held on its ends in the openings. The outside edges of the two openings are shaped radially inward, so that the pivot pin is held firmly in place relative to its axial direction.

Considering this solution, the latch hole of the latch is pivotably supported on the non-rotatably held pivot pin. At this point, any potential bearing wear is concentrated in a relatively small area.

Publication DE Patent 14407 discloses a latch needle, wherein the two openings provided in the lateral walls have a conical shape. The pivot pin is provided with rivet heads on its ends, said rivet heads being seated in the conical openings. In doing so, the pivot pin provides a rigid connection between the lateral walls.

DE Patent 917 243 discloses latch needles with a co-rotating pivot pin. To do so, a latch hole having a smaller diameter than that of the wall holes is provided. The pivot pin consists of plastic material and has a larger diameter than the latch hole; however, a smaller diameter than the wall holes. If said pivot pin is drawn with the appropriate force into the latch hole, said pin is seated in said hole in a press-fit manner. The ends of the pivot pin projecting from the latch are rotatably supported in the wall holes.

As opposed to this, publication DE 1 906 892 B is based on a pivot pin of steel. Again, the latch hole has a smaller diameter than the wall holes. The two openings provided in the lateral walls have a conical shape. The pivot pin is non-rotatably seated in the latch hole and is provided on its ends with conical heads that are rotatably seated in the conical openings. The pivot pin seated in the latch hole is upset in axial direction so that it is seated in the latch hole in a press-fit manner. The ends projecting from the latch hole form rivet heads shaped like truncated cones, said rivet heads being rotatably supported in the wall holes. Also in this case, the pivot pin establishes a rigid connection between the lateral walls.

Whereas the aforementioned publications basically assume the presence of pivot pins with two ends configured in essentially the same way, publication EP 2 224 048 A1 provides, in at least one embodiment, a pivot pin that has a larger diameter on both sides of the cheek hole than in the latch hole. The pivot pin receives its shape by one-sided upsetting. Consequently, the configuration of this pivot pin is asymmetrical.

The presented known latch bearings can involve problems in view of manufacturing engineering, useful life, precision or they may exhibit other disadvantages.

SUMMARY

It is the object of the invention to provide an improved latch bearing.

The method in accordance with the invention provides a needle base body with a shank that has a slot delimited by two lateral walls. The slot may be provided in the center of the shank or, in special cases, it may also be provided off-center. Therefore, the lateral walls have approximately the same thickness; however, they may also have different thicknesses. The inside of the lateral walls may be smooth or also stepped. Consequently, the slot may be delimited by parallel flanks and have a uniform thickness or may also be a slot with locally different widths. For example, the slot may be narrower on the needle breast and wider on the needle back. Other configurations are possible.

Bearing openings are provided in the lateral walls on oppositely located points. These bearing openings have a constant, preferably matching, cross-section, i.e., they taper neither in inward direction toward the slot nor in outward direction toward the needle flanks. The bearing openings may be cylindrical or also deviate from the cylindrical form and may be, e.g., tetragonal or polygonal and have a constant cross-section or be tapered (e.g., conical). The bearing openings may have the same relative, e.g., mirror-symmetrical form. On the slot and/or on the outside flank, they may be provided with small funnel-like expansions. However, between these adjoining chamfered regions, the bearing opening may have a constant cross-section or one of the aforementioned shapes.

The latch is disposed to open and close the hook. To accomplish this, the latch is pivotably supported by the needle base body. The end of the latch that can be brought into and out of engagement with the hook may be configured as a spoon or even as a narrow projection that engages in a recess of the hook. The shape of the latch may be varied or set, depending on the purpose of use.

The latch has a latch shank that is preferably configured as a narrow bridge fitting into the slot with minimal play. Preferably, the slot has plane surfaces on the sides facing the slot walls, said surfaces being oriented parallel to one other. However, these surfaces may also be provided with recesses, steps or the like.

The latch shank has a latch hole. This latch hole is preferably cylindrical or may also have a form that is not cylindrical, e.g., polygonal. Preferably, the latch hole has a constant cross-section. In order to facilitate assembly, the latch hole may be provided on both its edges with insertion chamfers, for example configured as small bezels. The latch hole has a smaller cross-section than the bearing openings in the slot walls. In the finished needle, the latch hole is concentric or, if desired, also eccentric with respect to the bearing heads.

In order to produce the latch bearing, the latch is first positioned in the slot, and then the cylindrical pin is inserted into the latch hole. The pin fits far enough into the latch hole so as to be seated in the latch hole with minimal play or also without appreciable play. Preferably, fitting is selected in such a manner that the pin is held in non-positive engagement in the latch hole. During a subsequent operating step the pin is axially upset so that preferably mirror-symmetrical bearing heads are formed on both ends of said pin. These bearing heads are positioned in the bearing openings. Preferably, both bearing heads adjoin the central pin section in a straight annular shoulder, said pin section being seated in the latch hole. In this way, the bearing surface available on the circumference of each bearing head is maximized.

Prior to the upsetting operation, the length of the cylindrical pin preferably exceeds the thickness of the needle base body, so that said pin projects on both sides of the bearing openings after it has been inserted into the latch hole. Before being upset, the pin is preferably centrally positioned so that it projects with the same length beyond both lateral surfaces of the needle. In this way, symmetrically configured bearing heads are formed on the pin during the upsetting operation.

It is possible to upset the pin in one operating step or also in several steps. For example, this can be accomplished with dies having a smooth or also stepped face. For example, during a first upsetting operation, the pin may be axially upset with dies having a flat face, so that, initially, approximately cylindrical bearing heads are formed. During a second, follow-up, upsetting operation, a die may be used that has a smaller diameter, so that an indentation will be embossed in each of the two bearing heads. Consequently, the shape of the bearing heads can be optimized. In addition, the central pin section seated in the latch hole can be expanded further as a result of this, so that a secure torque-proof seat of the pin in the latch hole is achieved. Preferably, the indentations provided in the outer sides of the bearing heads have a diameter that is smaller than the diameter of the section of the pin seated in the latch hole.

If the latch hole is round, the mentioned method can lead to a radial expansion of the central pin section and, consequently, result in a firm press fit of the pin in the latch hole.

However, the latch hole may also not be round or be configured as a cylindrical opening with additional shape features, e.g., edge-side notches. If the method is performed appropriately, the upsetting operation does not only result in a shaping of the bearing heads but also in an upsetting of the central pin section and, consequently, in a filling of the additional shape features with pin material. It is also possible to fill any polygonal latch holes in this manner—through the axially upset and thus radially expanding central pin section—with pin material, whereby the pin adapts to the shape of the latch hole and thus becomes non-round. The radial expansion results in a positive-locking, torque-proof engagement between the pin and the latch. In this way, it is possible to achieve a positive fit between the pin and the latch.

The latch needle in accordance with the invention comprises a bearing pin that is seated in the latch hole of the latch in a torque-proof manner. On both sides of the latch shank, the pin has heads that have been produced in an upsetting operation, said heads having a cylindrical outside circumference. These heads are disposed to support the latch in the bearing openings. Due to the cylindrical shape of the heads, these heads can axially shift in the bearing openings. As a result of this, the latch needle may be subject to elastic deformations during operation, said deformations changing the distance between the two slot walls. For example, the slot walls may flexibly deform in lateral direction. The pin that acts as the latch support does not inhibit such a deformation and movement. Also, the risk of a fluttering of the latch due to dynamic expansions of the slot is prevented.

By producing both bearing heads in an upsetting operation and due to the resultant symmetry between the bearing heads, the potential bearing wear affects both bearing heads uniformly. Thus, an inclined position of the latch or any other imprecision cannot occur due to progressing wear.

In contrast with latch bearings wherein the pins are shaped from the slot walls, the thickness of the lateral walls may be fixed relative to the needle slot width, i.e., deviating from the otherwise commonly used ⅓ rule. For example, referring to the needle in accordance with the invention, particularly wear-resistant latches or also weight-optimized thin latches may be used. The thickness of the latch shank can thus considerably exceed the thickness of a lateral wall or, in contrast thereto, be also substantially thinner than the thickness of the lateral wall. In reshaping the pin to produce a latch pivot with two bearing heads it is possible—by means of the original length of the pin, as well as by means of the shape and the travel of the reshaping tool and other method parameters—to determine how much play the latch and its latch bearing in the needle base body will have. Furthermore, off-center arrangements are possible.

The bearing heads may be concentrically arranged on the pin; however, it is also possible to arrange them eccentrically. As a result of this, the horizontal and/or the vertical position of the latch can be affected as a function of its pivoting position, without requiring a change of the position of the bearing openings in the lateral walls. This opens up the possibility of producing series of needles with partially different characteristics, e.g., different latches or latch positions, with the use of uniform needle base bodies.

Additional modifications are possible. For example, in the region of the latch bearing between the lateral walls and the latch shank, there may be a gap in which a spacer is arranged. The spacer may be a thin disc or also an annular bead adjoining the bearing head. For example, for producing such a stepped latch slot, the needle base body may have wider slot applied from the side of the needle back, whereby debris (fibers, abraded particles, avivage, oil, etc.) can exit toward the back of the needle, without impairing the mobility of the latch. The width of this additional slot may increase continuously or discontinuously from the needle breast toward the needle back.

The latch bearing in accordance with the invention is characterized by an increased bearing share in the bearing. This bearing share can be more than doubled compared with conventional latch bearings. Thus, lateral guiding of the latch is accordingly better. The lateral latch deflection on the hook is smaller than in other, commercially available, needles. Radial and axial latch play can also be reduced.

BRIEF DESCRIPTION OF THE DRAWINGS

The description and the drawings hereinafter disclose additional details of advantageous embodiments of the invention.

DETAILED DESCRIPTION

Figure 1:
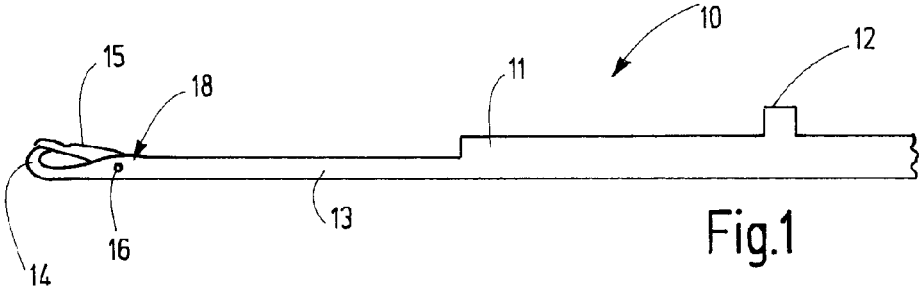
FIG. 1 comprises a schematized side view of a needle in accordance with the invention.

FIG. 1 shows a latch needle 10 comprising a needle base body 11 with a foot 12 disposed to drive the latch needle 10. Extending from the needle base body 11 is a shank 13 that has a hook 14 on its free end. In order to be able to open or close the hook 14, the hook 14 is associated with a latch 15 that can be pivoted toward and away from the hook 14 by means of a latch bearing 16. To this extent, the latch needle may be modified in almost any way. The latch needle may have a shank 13 that is straight or that may also have a meandering shape. The needle base body 11 may be configured as a cohesive body or be provided with recesses. One or more feet 12 may be provided. Instead of the foot 12, it is also possible to provide a coupling device for the connection of a driving, different, needle, a so-called coupling part. Furthermore, one or more optional parts may be provided on the needle base body 11, whereby these parts may be movably supported on said needle base body, for example.

The description hereinafter relates to the latch bearing 16 that has been developed by using the invention in a particular way. The latch bearing 16 can be seen in FIG. 3, for example. The latch 15 bearing a spoon on its end is supported by the latch bearing 16 so as to be pivotable about an axis 17, said axis extending transversely to the longitudinal direction of the needle. The latch bearing 16 is arranged in the region of the needle breast 18 in which a slot 19 for the accommodation of the latch is arranged. The latch 15 has a latch shank 20 extending into the slot 19, said latch shank comprising a spoon 21 (or another closing member) on the end remote from the latch bearing 16 and a latch hole 22 on its end located in the slot 19. The latch hole 22 may be configured, e.g., as a cylindrical passage opening or, alternatively, also as a conical passage opening. Preferably, it is circular; however, it may also have a different shape, e.g., have a polygonal or elliptical cross-section.

The slot 19 is delimited by two lateral walls 23, 24 that have bearing openings 25, 26. The bearing openings 25, 26 are arranged so as to be concentric with respect to the axis 17 and in alignment with one another. They are openings having a constant cross-section in longitudinal direction of the openings. For example, the bearing openings 25, 26 are cylindrical, in which case they may also be provided on the inside or outside edge with a bezel or an insertion chamfer. A pin 27 is disposed to support the latch 15, said pin being configured so as to be symmetrical with respect to the latch shank 20. A central section 28 fills the latch hole 22. Adjoining the central section 28 are the bearing heads 29, 30 that are configured so as to be mirror-symmetrical with respect to one another. The bearing heads 29, 30 are preferably cylindrical, in which case they may be slightly rounded on their edges. They are seated with minimal play in the bearing openings 25, 26. The faces 31, 32 of the bearing heads 29, 30 are flush with the lateral surfaces 33, 34 of the lateral walls 23, 24, or they extend slightly into the bearing openings 25, 26.

Figure 2:
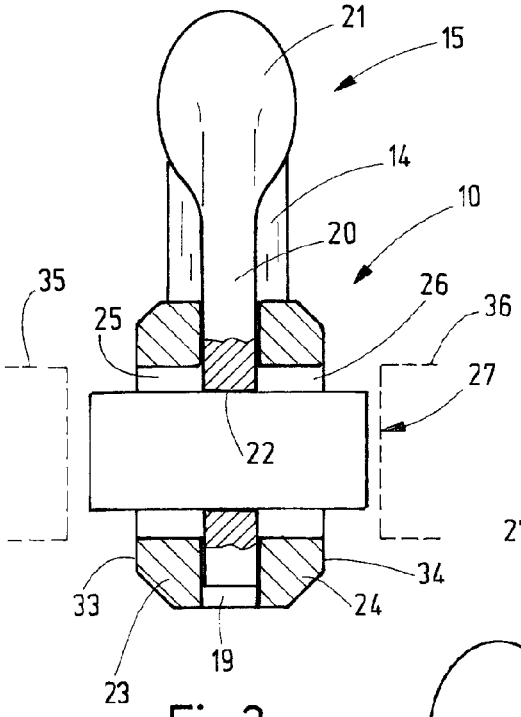
FIG. 2 comprises the needle as in FIG. 1, before upsetting its pivot pin.
Figure 3:
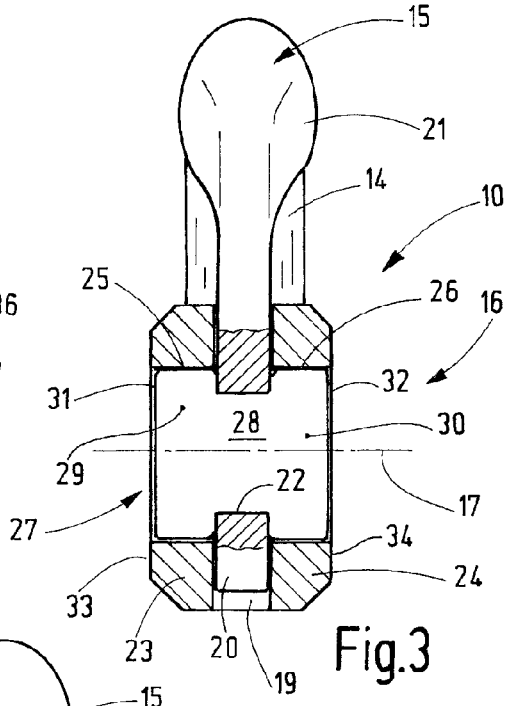
FIG. 3 comprises a cross-sectional view of the needle as in FIG. 1, after upsetting the pivot pin.

Preferably, the bearing heads 29, 30 have been shaped, at the same time, by an upsetting operation. To accomplish this, the needle base body 11 as in FIG. 2 is first provided, and the latch 15 is positioned in the slot 19. Subsequently, the initially still cylindrical pin 27, e.g., in the form of a wire section, is inserted into the latch hole 22. In doing so, the pin 27 is preferably centered so that both ends project with equal width from the bearing openings 25, 26 beyond the lateral surfaces 33, 34. Subsequently, the pin 27 is axially upset between two dies 35, 36 that are symmetrical to one another, said dies being indicated only schematically in dashed lines in FIG. 2. As a result of this, the bearing heads 29, 30 as in FIG. 3 are obtained. In addition, the central section 28 may be slightly upset, so that its diameter increases slightly and a non-positive engagement is established between the latch 15 and the pin 27.

During operation of the latch needle 10, the latch 15 can freely pivot between the hook 14 and a rear position in which the spoon 21 is located far from the hook 14. When the latch 15 pivots, the pin 27 rotates in the bearing openings 25, 26 due to the torque-proof coupling between the latch 15 and the pin 27. In doing so, the outside surfaces 31, 32 (circumferential surfaces) of the bearing heads 29, 30 provide radial guiding of the latch 15. The latch 15 may be guided on the inside surfaces of the lateral walls 23, 24 in order to precisely impact the hook 14, i.e., the latch deflection remains minimal even as the wear progresses. The bearing arrangement 26 may help guide the latch, i.e., for reducing the lateral pivot play of said latch.

Figure 4:
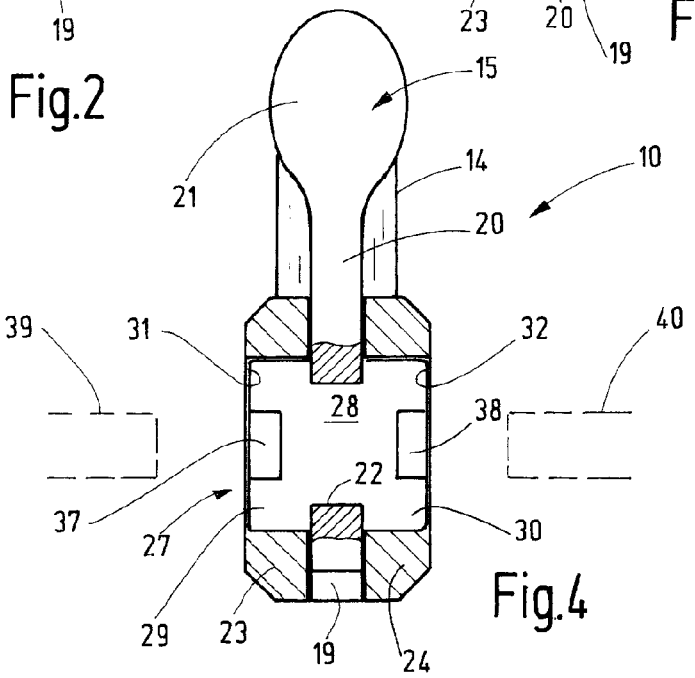
FIG. 4 comprises a cross-sectional view corresponding to FIG. 3, of a modified embodiment of the needle as in FIG. 1.

In a modified embodiment of the needle 10 as shown in FIG. 4, additional indentations 37, 38 are embossed in the faces 31, 32 of the pin 27, wherein said additional indentations may be round, polygonal, conical, spherical or also truncated conical. Preferably, this is accomplished with dies 39, 40 that have the appropriate shape as indicated in dashed lines in FIG. 4. Preferably, the two indentations 37, 38 are applied at the same time. By upsetting the pin 27 with the dies 35, 36 and/or the preferably symmetrically configured dies 39, 40, respectively at the same time, the remaining needle 10 is largely kept free of reshaping forces, and a symmetrical formation of the bearing heads 29, 30 of the pin 27 is the result. By embossing, e.g., cylindrical indentations 37, 38 or other indentations having preferably a constant cross-section in longitudinal direction, the formation of the shape of the bearing heads 29, 30 can be improved. Furthermore, the expansion of the central section 28 may be enhanced, so that the torque-proof connection between the pin 27 and the latch 15 is supported. Due to the shape of the bottom of the indentations 37, 38, it is possible to control the direction of material displacement. Whereas a conically recessed bottom promotes a lateral material displacement, a flat bottom, as shown in FIG. 4, is disposed to enlarge the diameter of the central section 28.

Stepped dies may also be used instead of the dies 35, 36; 39, 40, so that reshaping of the pin 27 takes place not in two steps but in one step.

Figure 5:
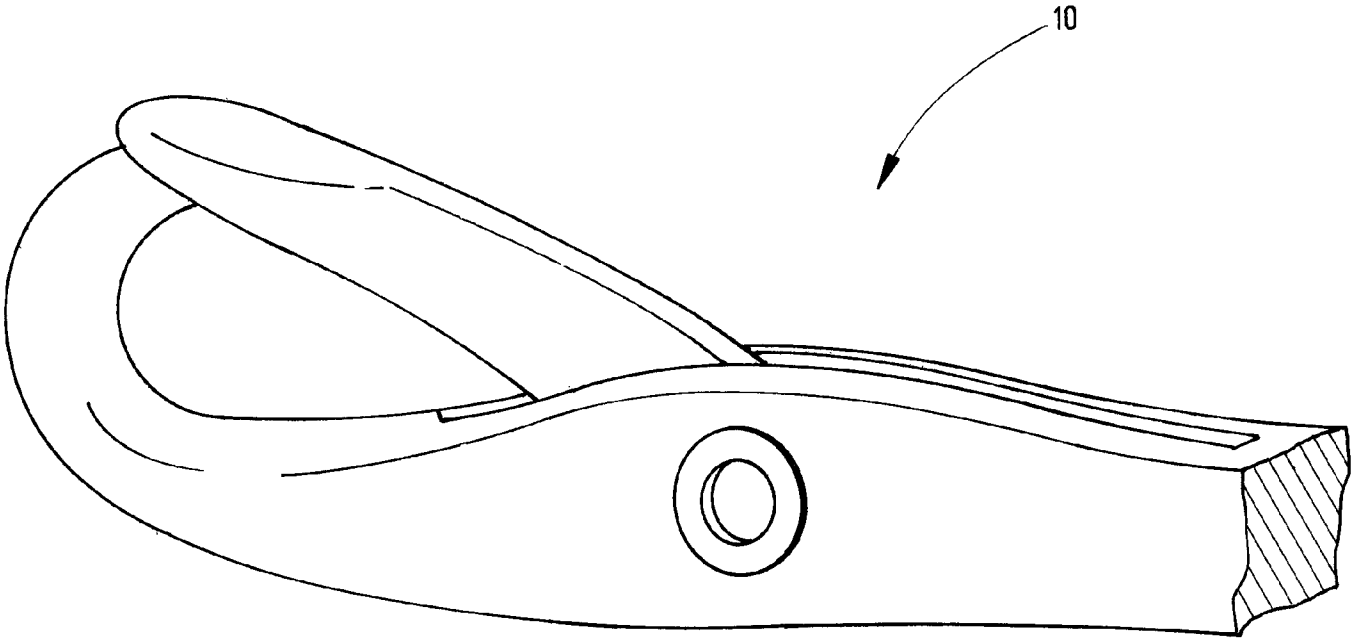
FIG. 5 comprises a perspective view of a detail of the needle as in FIG. 4.
Figure 6:
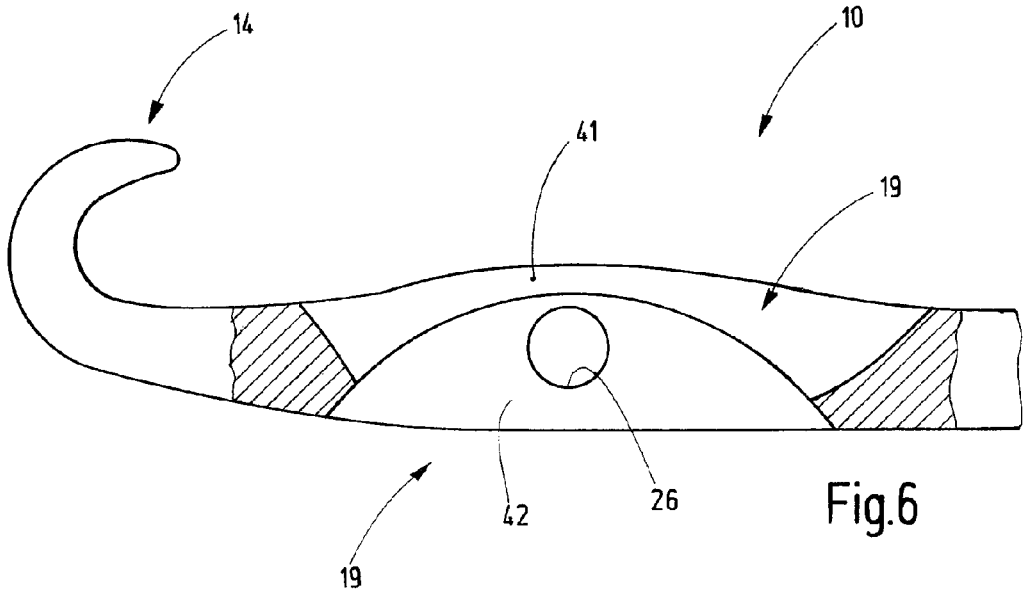
FIG. 6 comprises a side view, partially in section, of a modified embodiment of the needle in accordance with the invention, without latch.

As again illustrated in FIG. 5, the needle 10 functions as has already been described above in conjunction with FIGS. 1 through 4. The needle 10 that has been described so far has lateral walls 23, 24 that, between them, delimit a slot 19 having a constant width. However, it is also possible to provide the slot 19 with a variable width. To accomplish this, FIG. 6 shows a detail of a needle 10, wherein the slot 19 of said needle has a section 41 of narrow width in the region close to its breast and a second section 42 of greater width on the needle back. The bearing openings 25, 26 are preferably provided in the section 42 having the greater width; however, this is not absolutely necessary. In FIG. 6, only the bearing opening 26 is visible.

Spacing means may be provided between the latch shank 20 and the lateral walls 23 and 24, respectively. Such spacing means may be, e.g., structures that project radially beyond the edge of the bearing openings 25, 26 such as, e.g., annular beads 43, 44, that are provided on the bearing heads 29, 30. In doing so, the annular beads 43, 44 preferably extend radially beyond the cylindrical outside surfaces of the bearing heads 29, 30 and thus form annular flanges. The diameter of the annular beads exceeds the diameter of the bearing openings 25, 26. Instead of these annular beads 43, 44, it is also possible to provide spacer discs of metal or plastic material.

Figure 7:
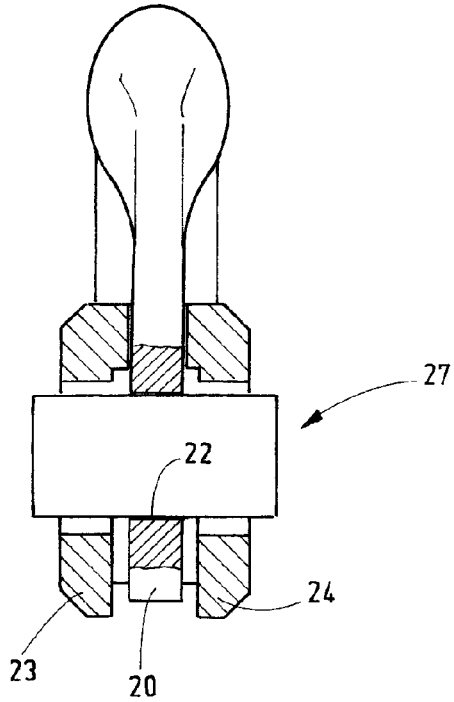
FIG. 7 comprises the needle as in FIG. 6, during manufacture, before upsetting its pivot pin.
Figure 8:
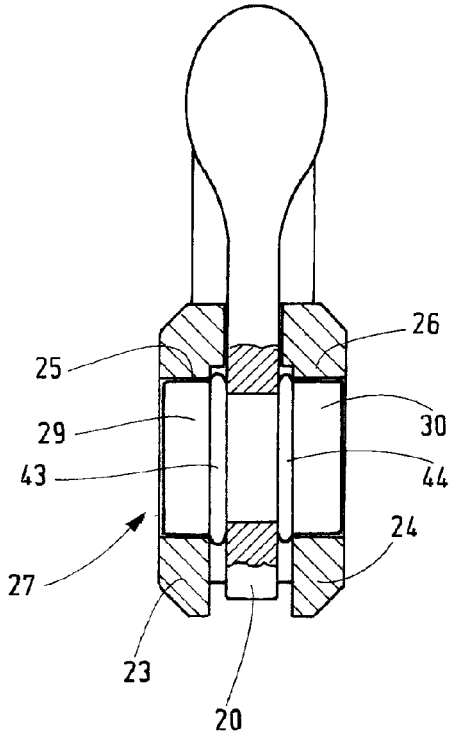
FIG. 8 comprises a cross-sectional view of the needle as in FIG. 6, with the pivot pin and the latch.

In order to produce the stepped pin 27, again a cylindrical pin 27 is used to start with, as shown in FIG. 7. This pin is axially upset in accordance with FIG. 3 as well as, optionally, FIG. 4, so that the bearing heads 29, 30 and also the annular beads 43, 44 are formed. Alternatively, instead of having the annular beads 43, 44, it is possible to insert spacer discs in the gap between the latch shank 20 and the lateral walls 23, 24. The pin 27 is positioned in the center of the latch hole 22 (using the ⅓ rule) and upset accordingly in order to produce the desired shape as in FIG. 8.

Figure 9:
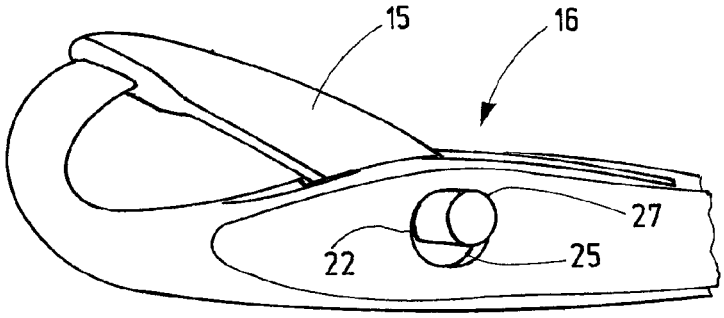
FIG. 9 comprises a lateral perspective view of a modified embodiment of a needle with an eccentric latch bearing, before upsetting the bearing pin.
Figure 10:
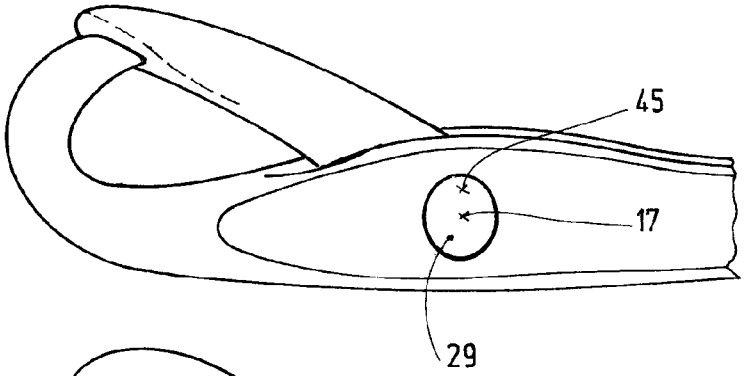
FIG. 10 comprises the needle as in FIG. 9, after upsetting the pin.
Figure 11:
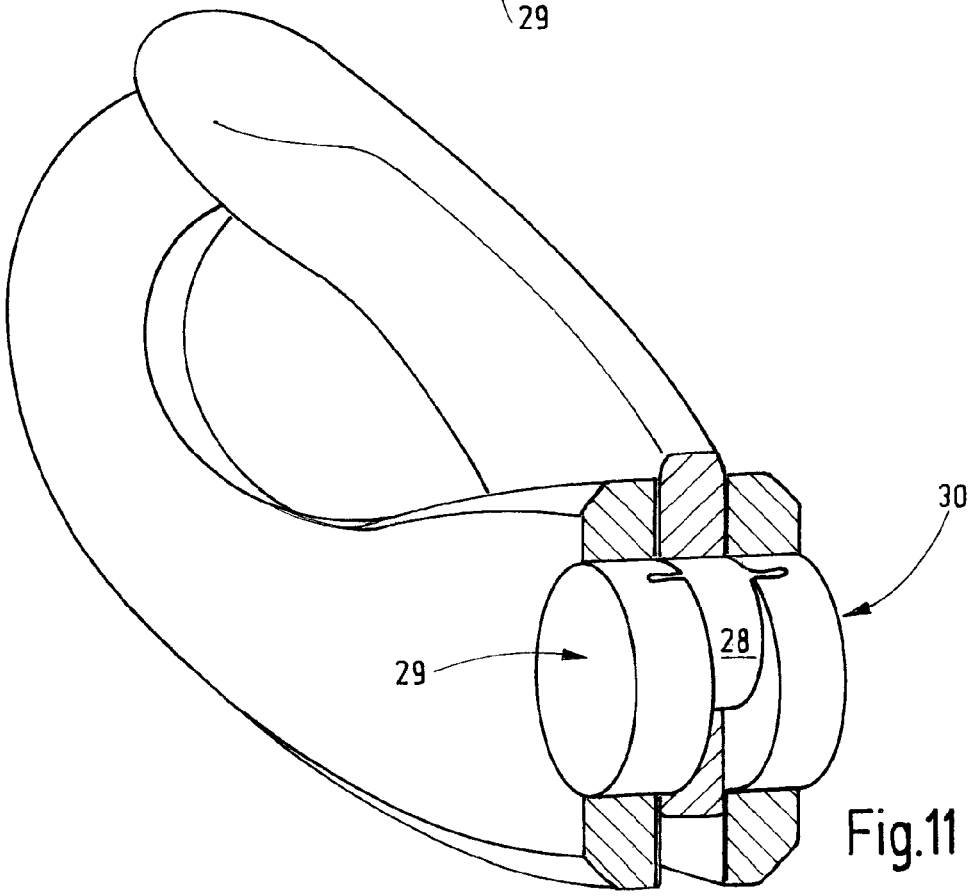
FIG. 11 comprises a partially cut open side view of the needle as in FIG. 9, with the latch and after upsetting the pin.

Referring to the aforementioned exemplary embodiments it was assumed that the lateral surfaces of the latch shank 20 are smooth and parallel to one another. However, they may also have recesses, notches, indentations, bulges, steps or the like. Furthermore, hereinabove it was assumed that not only the bearing openings 25, 26 but also the latch hole 22 are positioned so as to be concentric to the axis 17, so that the central section 28 and the bearing heads 29, 30 are also concentric. However, in all of the aforementioned embodiments it is also possible to choose an eccentric arrangement. FIGS. 9 through 11 illustrate this. If, e.g., an eccentric latch bearing 16 is to be produced, the latch 15—as shown in FIG. 9—may be positioned in such a manner that the latch hole 22 is indeed located within the bearing openings 25, 26 but is eccentric with respect to them. When the pin 27 is subsequently being upset, the resultant bearing heads 29, 30 may form so as to be eccentric with respect to the remaining central section 28. Consequently, the center line 45 of the central section 28 is eccentrically offset with respect to the center axis 17, as is shown by FIG. 10. This is particularly obvious from FIG. 11.

Figure 12:
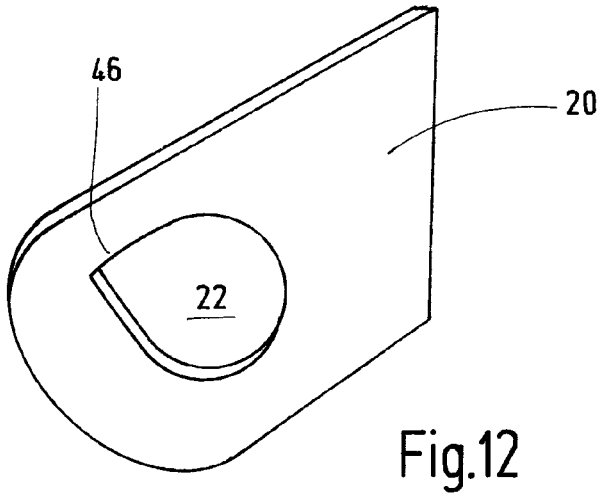
FIGS. 12-14 comprises a perspective representations of details of various latch hole shapes on latch shanks.

Hereinabove, a preferably cylindrical latch hole 22 was assumed. However, in all of the aforementioned embodiments, it is also possible to select a different shape of the latch hole 22. For example, FIG. 12 shows a latch hole 22 that deviates in one region of its edge from the otherwise maintained circular form. Consequently, an additional shape feature 46 exists into which can flow material of the central section 28, so that a form-fitting, torque-proof coupling exists between the pin 27 and the latch shank 20.

Figure 13:
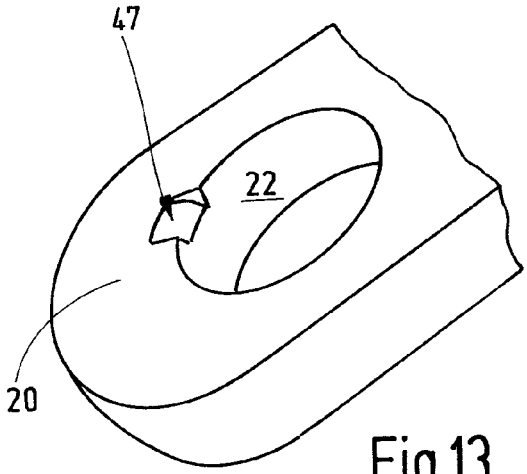
Figure 14:
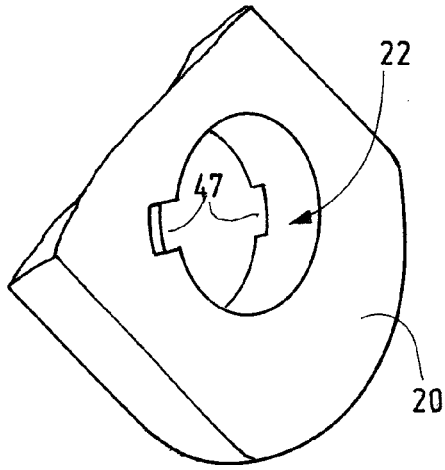

Corresponding shape features may also be provided, e.g., in accordance with FIG. 13, by an edge-side notch 47 that, on the one hand, intersects the wall of the latch hole 22 and, on the other hand, extends into the flat side of the latch shank 20. As is shown by FIG. 14, such notches 47 may be provided on one or on several points as well as on one or on several edges of the latch hole 22.

Figure 16:
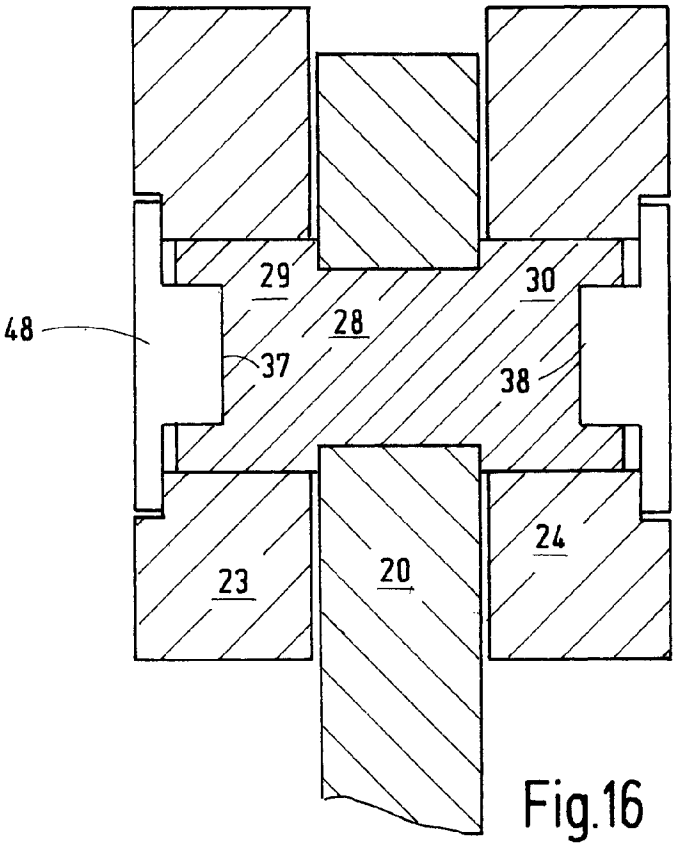
FIGS. 15 and 16 comprises a cross-sectional illustrations of a modified embodiment of a needle, with the latch bearing covered.
Figure 15:
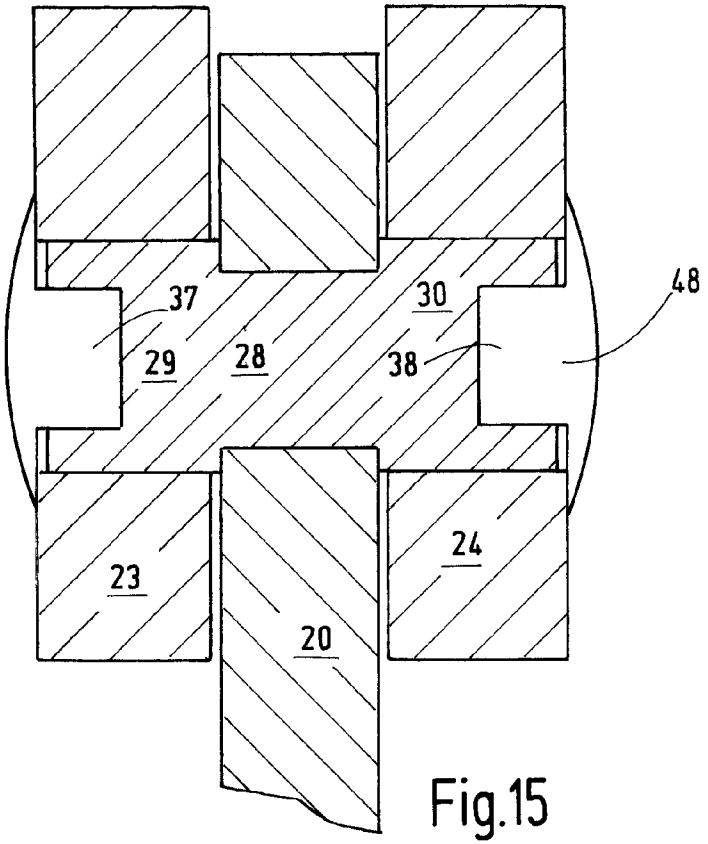

FIGS. 15 and 16 show options for covering the latch bearing 16 in accordance with the invention. In particular, when processing filament yarns having a very high short-fiber content, a cover 48 of the latch bearing 16 can prevent fibers and other debris from getting into the intermediate spaces of the latch bearing 16. The covers 48 can be held in the indentations 37, 38 of the bearing heads 29, 30, e.g., in a non-positive manner, i.e., they may be pressed in or also clipped in. FIG. 15 thus shows a simple embodiment of a cover that extends beyond the width of the needle shank. Different therefrom, FIG. 16 shows a more thread-sparing embodiment in which the cover is countersunk. To accomplish this, an additional recess is provided in the cheek wall for accommodating the cover.

A latch needle in accordance with the invention comprises a pivot pin connected with the latch in a torque-proof manner, said pivot pin having mirror-symmetrically shaped bearing heads 29, 30 on both sides of the latch shank 20. The bearing heads 29, 30 are produced by plastic deformation (i.e., axial upsetting of a pin 27) and have a cylindrical exterior shape.

LIST OF REFERENCE SIGNS

10 Latch needle
11 Foot
12 Needle base body
13 Shank
14 Hook
15 Latch
16 Latch bearing
17 Axis
18 Needle breast
19 Slot
20 Latch shank
21 Latch spoon
22 Latch hole
23, 24 Lateral walls
25, 26 Bearing opening
27 Pin
28 Central section
29, 30 Bearing heads
31, 32 Faces (circumferential surfaces) of the bearing heads 29, 30
33, 34 Lateral surfaces of the lateral walls 23, 24
35, 36 Die
37, 38 Indentation
39, 40 Die
41 Section of the slot 19 with smaller width
42 Section of the slot 19 with greater width
43, 44 Annular beads
45 Center line of section 28
46 Shape feature
47 Notch
48 Cover

What is claimed:

1. Method for the manufacture of a latch bearing of a latch needle, the method comprising:

providing of a needle base body having a shank in which is shaped a slot, said slot being delimited by two lateral walls;

forming of two bearing openings in the slot walls, said bearing openings having matching shapes and being in alignment with one another;

providing of a latch having a latch shank with a latch hole being a through hole, the cross-section of said latch hole being different from the cross-section of the bearing openings;

positioning of one end of the latch in the slot, so that the latch hole is located in the region of the bearing openings;

inserting of a pin into the latch hole; and deforming the pin on both sides to produce cylindrical bearing heads within the bearing openings;

wherein the pin is non-rotatable connected with the latch by form-fitting or by non-positive engagement.

2. The method of claim 1, characterized in that the length of the cylindrical pin exceeds the thickness of the needle base body, so that, after inserting the pin into the latch hole, said pin projects from both sides of the bearing openings.

3. The method of claim 1, characterized in that, for upsetting the pin, two dies that are in alignment with each other are used, said dies being stepped or having smooth non-stepped faces for shaping matching symmetrical bearing heads in the bearing openings.

4. The method of claim 1, characterized in that the upsetting operation is performed in several steps in which various dies are used as upsetting tools.

5. The method of claim 1, characterized in that, during the upsetting operation, the diameter of the pin is also enlarged in the region of the latch hole in order to establish a form-fitting and/or non-positive torque-proof connection between the pin and the latch.

6. Latch needle comprising:

needle base body having a shank in which is formed a slot, said slot being delimited by two lateral walls, wherein two bearing holes being through-holes in alignment with one another are formed with matching constant cross-sections through the slot walls;

a latch having a latch shank with a latch hole being a through hole, the cross-section of said latch hole being smaller than the cross-section of the bearing holes;

a bearing pin extending through the latch hole and having, within the two bearing holes, bearing heads of matching shape, said bearing heads having been produced together by plastic deformation and wherein the bearing pin is non-rotatably connected with the latch by form-fitting or by non-positive engagement.

7. The latch needle as in claim 6, characterized in that the thickness of the latch shank measured in longitudinal direction of the latch hole is greater or smaller than the thickness of a slot wall measured in the same direction.

8. The latch needle as in claim 6, characterized in that the bearing heads have a prismatic or cylindrical indentation on their respectively outward-facing sides.

9. The latch needle as in claim 6, characterized in that the bearing heads are arranged concentrically with respect to a center of the pin, the center of the pin extending through the latch hole.

10. The latch needle as in claim 6, characterized in that the bearing heads have a center of rotation that is eccentric from a center of rotation of the pin.

11. The latch needle as in claim 6, further comprising a spacer disk arranged between the shank and the slot walls.

12. The latch needle as in claim 6, further comprising a bead arranged between the shank and the slot walls.

13. The latch needle as in claim 6, characterized in that the latch hole has a cylindrical shape.

14. The latch needle as in claim 6, characterized in that the latch hole comprises at least one shape feature that is different from the cylindrical shape.

* * * * *